US005347953A

United States Patent [19]

Adbulally

[11] Patent Number: 5,347,953

[45] Date of Patent: Sep. 20, 1994

[54] FLUIDIZED BED COMBUSTION METHOD UTILIZING FINE AND COARSE SORBENT FEED

[75] Inventor: Igbal F. Adbulally, Randolph, N.J.

[73] Assignee: Foster Wheeler Energy Corporation, Clinton, N.J.

[21] Appl. No.: 709,243

[22] Filed: Jun. 3, 1991

[51] Int. Cl.[5] ..... B09B 3/00; F23G 5/00

[52] U.S. Cl. ..... 122/4 D; 110/245

[58] Field of Search ..... 110/245, 345, 347; 122/4 D; 422/145

[56] References Cited

U.S. PATENT DOCUMENTS

| | | | |
|---|---|---|---|
| 3,902,462 | 9/1975 | Bryers | 110/245 |
| 4,184,456 | 1/1980 | Taylor et al. | 110/245 |
| 4,249,470 | 2/1981 | Vatsky | 431/284 |
| 4,275,668 | 6/1981 | Daman | 110/245 |
| 4,434,726 | 3/1984 | Jones | 110/245 |
| 4,474,119 | 10/1984 | Jones | 110/245 |
| 4,476,790 | 10/1984 | Borio et al. | 110/245 |
| 4,548,138 | 10/1985 | Korenberg | 110/245 |
| 4,597,774 | 7/1986 | Garcia-Mallol et al. | 422/145 |
| 4,809,623 | 3/1989 | Garcia-Mallol | 110/245 |
| 4,829,912 | 5/1989 | Alliston et al. | 110/245 |
| 4,896,717 | 1/1990 | Campbell, Jr. et al. | 110/245 |
| 4,936,770 | 6/1990 | Adbulally | 122/4 D |
| 5,040,492 | 8/1991 | Dietz | 122/4 D |
| 5,069,170 | 12/1991 | Gorzegno et al. | 122/4 D |

*Primary Examiner*—A. Michael Chambers
*Attorney, Agent, or Firm*—Marvin A. Naigur

[57] ABSTRACT

A fluidized bed combustion method utilizing fine and coarse sorbent feed to control the temperature of a cooling fluid such as water or steam circulating through a fluid flow circuit of a fluidized bed combustor. Fuel particles, such as coal, along with relatively fine and relatively coarse sorbent material, such as limestone, are fed into the furnace section of a fluidized bed reactor. The fuel is combusted, and a fluidizing gas such as air is introduced into the furnace section. Flue gases and entrained material pass from the furnace section, and the entrained material is separated from the flue gases. The separated entrained material passes to a recycle heat exchange section and is cooled before being passed to the furnace section. The recycle heat exchange section is provided with heat exchange surfaces which form part of a fluid flow circuit to transfer heat from the separated entrained material to a cooling fluid such as water or steam which is circulating through the circuit. The ratio of fine to coarse sorbent feed is controlled to control the heat transfer from the separated entrained material in the recycle heat exchange section to the cooling fluid, thereby controlling the temperature of the cooling fluid and enabling the temperature of the cooling fluid to be held constant over a range of fluidized bed reactor loads.

22 Claims, 1 Drawing Sheet

FLUIDIZED BED COMBUSTION METHOD UTILIZING FINE AND COARSE SORBENT FEED

BACKGROUND OF THE INVENTION

This invention relates to a method of operating a fluidized bed reactor and, more particularly, to such a method in which a recycle heat exchanger is formed integrally with the furnace section of the system and the ratio of fine to coarse sorbent feed is regulated to control operational characteristics of the system.

Fluidized bed combustion systems are well known and include a furnace section in which air is passed through a bed of particulate material, including a fossil fuel, such as coal, and a sorbent for the oxides of sulfur generated as a result of combustion of the coal, to fluidize the bed and to promote the combustion of the fuel at a relatively low temperature. These types of combustion systems are often used in steam generators in which water is passed in a heat exchange relationship to the fluidized bed to generate steam and permit high combustion efficiency and fuel flexibility, high sulfur adsorption and low nitrogen oxides emissions.

The most typical fluidized bed utilized in the furnace section of these type systems is commonly referred to as a "bubbling" fluidized bed in which the bed of particulate material has a relatively high density and a well-defined, or discrete, upper surface. Other types of systems utilize a "circulating" fluidized bed in which the fluidized bed density is below that of a typical bubbling fluidized bed, the fluidizing air velocity is equal to or greater than that of a bubbling bed, and the flue gases passing through the bed entrain a substantial amount of the fine particulate solids to the extent that they are substantially saturated therewith.

Circulating fluidized beds are characterized by relatively high internal and external solids recycling which makes them insensitive to fuel heat release patterns, thus minimizing temperature variations and, therefore, stabilizing the sulfur emissions at a low level. The high external solids recycling is achieved by disposing a cyclone separator at the furnace section outlet to receive the flue gases, and the solids entrained thereby, from the fluidized bed. The solids are separated from the flue gases in the separator and the flue gases are passed to a heat recovery area while the solids are recycled back to the furnace. This recycling improves the efficiency of the separator, and the resulting increase in the efficient use of sulfur adsorbent and fuel residence times reduces the adsorbent and fuel consumption.

In the operation of these types of fluidized beds, and, more particularly, those of the circulating type, there are several important considerations. For example, the flue gases and entrained solids must be maintained in the furnace section at a particular temperature (usually approximately 1600° F.) consistent with proper sulfur capture by the adsorbent. As a result, the maximum heat capacity (head) of the flue gases passed to the heat recovery area and the maximum heat capacity of the separated solids recycled through the cyclone and to the furnace section are limited by this temperature. In a cycle requiring only superheat duty and no reheat duty, the heat content of the flue gases at the furnace section outlet is usually sufficient to provide the necessary heat for use in the heat recovery area of the steam generator downstream of the separator. Therefore, the heat content of the recycled solids is not needed.

However, in a steam generator using a circulating fluidized bed with sulfur capture and a cycle that requires reheat duty as well as superheater duty, the existing heat available in the flue gases at the furnace section outlet may not be sufficient. At the same time, heat in the furnace/cyclone/recycle loop is in excess of the steam generator duty requirements. For such a cycle, the design must be such that the heat in the recycled solids must be utilized before the solids are reintroduced to the furnace section.

To provide this extra heat capacity, a recycle heat exchange section is sometimes located between the separator solids outlet and the fluidized bed of the furnace section. The recycle heat exchange section includes heat exchange surfaces, receives the separated solids from the separator, and functions to transfer heat from the solids to the heat exchange surfaces at relatively high heat transfer rates before the solids are reintroduced to the furnace section. The heat from the heat exchange surfaces is then transferred to cooling circuits to supply reheat and/or superheat duty. It is understood that any number of arrangements for the recycle heat exchange section may be used. Examples of recycle heat exchange sections that may be used are disclosed in U.S. application Ser. No. 371,170, and U.S. application Ser. No. 486,652, both assigned to the assignee of the present invention, the disclosures of which are hereby incorporated by reference.

Although the circulating fluidized bed which employs a recycle heat exchange section enjoys several operational advantages when compared to a circulating fluidized bed which does not, it is not without problems. For example, when a circulating fluidized bed is used as a steam generator, it is generally desirable to be able to maintain the steam at a fairly constant temperature over a range of loads. However the temperature of the steam in the fluid flow circuit leaving the recycle heat exchange section tends to increase as the load on the fluidized bed increases. Uncontrolled, the steam temperature will continue to increase, with increasing loads, even beyond the desired temperature for the steam.

Due to the need to maintain the steam at a constant temperature over a range of fluidized bed reactor loads, these arrangements typically have oversized heat exchange surfaces in the recycle heat exchange section to permit the fluidized bed to reach a desired steam temperature at a relatively low load. In these arrangements a desuperheater is typically used to remove heat from the steam as the steam temperature begins to rise above the desired temperature. Several methods of desuperheating are used, ranging from disposing heat exchange surfaces in the fluid flow circuit to remove heat therefrom to spraying the outer surfaces of the fluid flow circuit with a coolant. These techniques are, however, inefficient and result in relatively slow start-ups and load change capabilities since the solids inventory and the furnace combustor cannot be adjusted rapidly as demanded by the operational requirements, especially since the sorbent material introduced into the fluidized bed is usually of only one particle size.

SUMMARY OF THE INVENTION

It is, therefore, an object of the present invention to provide a fluidized bed combustion method which permits the fluid circulating in a fluid flow circuit to be maintained at a fairly constant temperature over a relatively large range of fluidized bed reactor loads.

It is a further object of the present invention to provide a method of the above type which reduces or eliminates the need for costly and inefficient desuperheating of the fluid in a fluid flow circuit for the maintenance of a fairly constant cooling fluid temperature over a range of fluidized bed reactor loads.

It is a further object of the present invention to provide a method of the above type which reduces the need for oversizing heat exchange areas of a fluid flow circuit for the maintenance of a fairly constant fluid temperature over a range of fluidized bed reactor loads.

It is a further object of the present invention to provide a method of the above type which permits faster start-ups and load changes.

It is a further object of the present invention to provide a fluidized bed combustion method which utilizes sorbent of varying particle sizes to improve operational characteristics of a fluidized bed reactor.

It is a further object of the present invention to provide a method of the above type in which the ratio of fine to coarse sorbent feed is varied to control operational characteristics.

It is a further object of the present invention to provide a method of the above type in which the solids inventory in the furnace combustor can be adjusted rapidly as demanded by operational requirements.

Toward the fulfillment of these and other objects, the method of the present invention comprises forming a furnace section and a recycle heat exchange section, and introducing fuel particles and relatively fine and relatively coarse sorbent material into the furnace section. The fuel particles are combusted, and the bed is fluidized so that the fluidizing gas combines with the gaseous products of combustion to form flue gases which entrain portions of the fuel particles, solid products of combustion, and fine and coarse sorbent materials. The flue gases and entrained material pass from the furnace section, and the entrained material is separated from the flue gases. The separated entrained material is passed to a recycle heat exchange section in which the separated entrained material is cooled before being returned to the furnace section. The separated entrained material is cooled by a fluid flow circuit which includes heat exchange surfaces in the recycle heat exchange section to transfer heat from the separated entrained material to a cooling fluid, such as water or steam or a water and steam mixture. The heat transfer to the cooling fluid in the recycle heat exchange section is then controlled by controlling the ratio of fine to coarse sorbent material introduced into the furnace section, thus enabling the temperature of the cooling fluid to be held constant over a range of fluidized bed reactor loads, while reducing or eliminating the need to oversize heat exchange surfaces in the fluid flow circuit and the need to desuperheat the cooling fluid.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawing wherein.

DESCRIPTION OF THE PREFERRED EMBODIMENT

Figure 1:
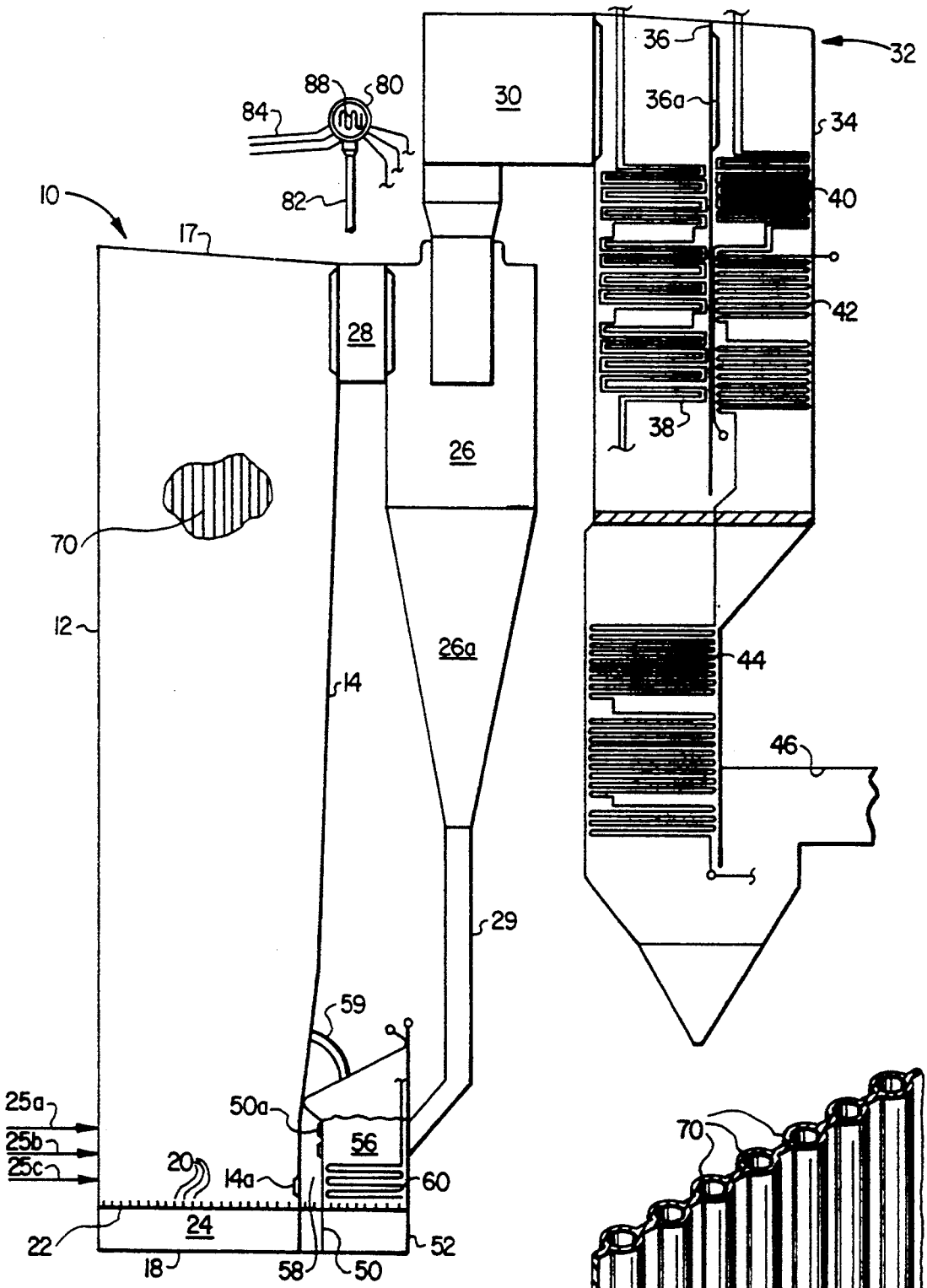
FIG. 1 is a schematic representation depicting a fluidized bed combustion system for practicing the method of the present invention.

The drawings depict a fluidized bed combustion system used for the generation of steam and including an upright water-cooled enclosure, referred to in general by the reference numeral 10, having a front wall 12, a rear wall 14 and two side walls (not shown). The upper portion of the enclosure 10 is enclosed by a roof 17 and the lower portion includes a floor 18.

A plurality of air distributor nozzles 20 are mounted in corresponding openings formed in a plate 22 extending across the lower portion of the enclosure 10. The plate 22 is spaced from the floor 18 to define an air plenum 24 which is adapted to receive air from external sources (not shown) and selectively distribute the air through the plate 22 and to portions of the enclosure 10, as will be described.

The furnace section receives fuel particles, such as coal, and relatively coarse and relatively fine sorbent material, such as limestone, through conduits **25*a*, 25*b*, and 25*c*, respectively. It is understood that any number of arrangements for providing fuel particles and sorbent material to the fluidized bed may be used. Examples of a few of the arrangements that can be used are disclosed in U.S. Pat. No. 4,936,770, assigned to the assignee of the present invention, the disclosure of which is hereby incorporated by reference. The mixture of coal and fine and coarse sorbent material is fluidized by the air from the plenum 24 as the air passes upwardly through the plate 22. The air promotes the combustion of the fuel, and the sorbent material adsorbs the sulfur generated by the combustion of the fuel. The resulting mixture of combustion gases and the air (hereinafter termed "flue gases") rises in the enclosure by forced convection and entrains portions of the fuel particles, solid products of combustion, and fine and coarse sorbent materials to form a column of decreasing solids density in the upright enclosure 10** to a given elevation, above which the density remains substantially constant.

A cyclone separator 26 extends adjacent the enclosure 10 and is connected thereto via a duct 28 extending from an outlet provided in the rear wall 14 of the enclosure 10 to an inlet provided through the separator wall. The lower portion of the separator 26 includes a hopper **26*a* which is connected by a dip leg 29 to a recycle heat exchange section. Although reference is made to one separator 26, it is understood that one or more additional separators (not shown) may be disposed near the separator 26**. The number and size of separators used is determined by the capacity of the steam generator and economic considerations.

The separator 26 receives the flue gases and the entrained material from the enclosure 10 in a manner to be described and operates in a conventional manner to disengage the entrained material from the flue gases. The separated flue gases, which are substantially free of solids, pass, via a duct 30 located immediately above the separator 26, into a heat recovery section shown in general by the reference numeral 32.

The heat recovery section 32 includes an enclosure 34 divided by a vertical partition 36 into a first passage which houses a reheater 38, and a second passage which houses a primary superheater 40 and an upper economizer 42, all of which are formed by a plurality of heat exchange tubes extending in the path of the flue gases as the flue gases pass through the enclosure 34. An opening 36a is provided in the upper portion of the partition 36 to permit a portion of the gases to flow into the passage containing the superheater 40 and the upper economizer 42. After passing across the reheater 38, the superheater 40 and the upper economizer 42 in the two parallel passes, the gases pass through a lower economizer 44 before exiting the enclosure 34 through an outlet 46.

As shown in FIG. 1, the floor 18 and the plate 22 are extended past the rear wall 14 and a pair of vertically extending, spaced, parallel partitions 50 and 52 extend upwardly from the floor 18. The upper portion of the partition 50 is bent towards the rear wall 14 to form a sealed boundary, and then towards the partition 52 with its upper end extending adjacent, and slightly bent back from, the latter wall, to form another sealed boundary. Spaced openings 50a are formed in the partition 50, and spaced openings 14a are formed in the lower portion of the rear wall 14 to establish flow paths for the solids.

The front wall 12 and the rear wall 14 define a furnace section 54, the partitions 50 and 52 define a recycle heat exchange section 56 and the rear wall 14 and the partition 50 define an outlet chamber 58 for the recycle heat exchange section 56 which chamber is sealed off at its upper portion by the bent portion of the partition 50. The floor 18 and the plate 22, and therefore the plenum 24, extend through the outlet chamber 58 and the recycle heat exchange section 56. Additional nozzles 20 are provided through the extended portions of the plate 22. A vent pipe 59 connects an opening in the rear wall 14 with an opening in the partition 50 to place the furnace section 54 and the recycle heat exchange section 56 in communication for reasons to be described. A plurality of heat exchange tubes 60 are disposed in the recycle heat exchange section 56.

Figure 2:
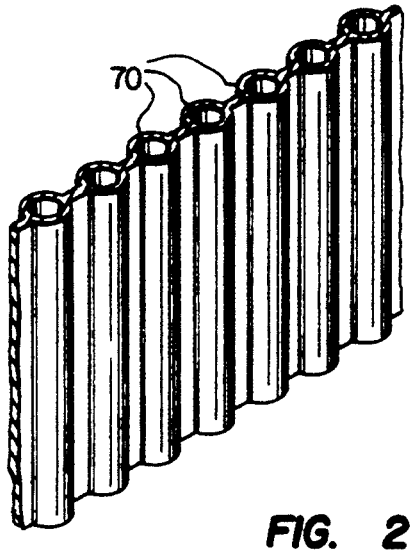
FIG. 2 is a partial, enlarged perspective view of a portion of a wall of the enclosure of the system of FIG. 1.

The front wall 12, the rear wall 14, the sidewalls, the partitions 50 and 52, the roof 17, and the walls defining the heat recovery enclosure 34 all are formed of membrane-type walls an example of which is depicted in FIG. 2. As shown, each wall is formed by a plurality of finned tubes 70 disposed in a vertically extending, air tight relationship with adjacent finned tubes being connected along their lengths.

A steam drum 80 (FIG. 1) is located above the enclosure 10 and, although not shown in the drawings, it is understood that a plurality of headers are disposed at the ends of the various walls described above. Also, a plurality of downcomers and pipes, such as shown by the reference numerals 82 and 84, respectively, are utilized to establish a steam and water flow circuit through the tubes 70 forming the aforementioned water tube walls, along with connecting feeders, risers, headers, etc. The boundary walls of the cyclone separator 26, the heat exchanger tubes 60 and the tubes forming the reheater 38 and the superheater 40 are steam cooled while the economizers 42 and 44 receive feed water and discharge it to the drum 80. Water is passed in a predetermined sequence through this flow circuitry to convert the water to steam and to heat the steam by the heat generated by the combustion of the fuel particles in the furnace section 54.

In operation, fuel particles and relatively fine and relatively coarse sorbent material are introduced into the furnace section 54 through conduits 25a, 25b, and 25c. Air from an external source is introduced at a sufficient pressure into that portion of the plenum 24 extending below the furnace section 54, and the air passes through the nozzles 20 disposed in the furnace section 54 at a sufficient quantity and velocity to fluidize the solids in the furnace section.

A lightoff burner (not shown), or the like, is provided to ignite the fuel particles, and thereafter the fuel particles are self-combusted by the heat in the furnace section. The mixture of air and gaseous products of combustion (hereinafter referred to as "flue gases") passes upwardly through the furnace section 54 and entrains, or elutriates, portions of the fuel particles, solid products of combustion, and fine and coarse sorbent materials (hereinafter referred to as "solids"). The quantity of the air introduced, via the air plenum 24, through the nozzles 20 and into the interior of the furnace section 54 is established in accordance with the size of the solids so that a circulating fluidized bed is formed, i.e. the solids are fluidized to an extent that substantial entrainment or elutriation thereof is achieved. Thus the flue gases passing into the upper portion of the furnace section 54 are substantially saturated with the solids, and the arrangement is such that the density of the bed is relatively high in the lower portion of the furnace section 54, decreases with height throughout the length of this furnace section and is substantially constant and relatively low in the upper portion of the furnace section.

The saturated flue gases in the upper portion of the furnace section 54 exit into the duct 28 and pass into the cyclone separator(s) 26. In each separator 26, the solids are separated from the flue gases, and the solids pass from the separator through the dipleg 29 and into the recycle heat exchange section 56. The cleaned flue gases from the separator 26 exit, via the duct 30, and pass to the heat recovery section 32 for passage through the enclosure 34 and across the reheater 38, the superheater 40, and the economizers 42 and 44, before exiting through the outlet 46 to external equipment.

The separated solids from the dipleg 29 enter the recycle heat exchange section 56. Air is passed into the plenum 24 extending below the section and is discharged through the corresponding nozzles 20 into the recycle heat exchange section 56. Thus, the solids in the recycle heat exchange section 56 are fluidized and pass in a generally upwardly direction across the heat exchange tubes 60 before exiting, via the openings 50a into the outlet chamber 58. The solids mix in the chamber 58 before they exit, via the lower openings 14a formed in the rear wall 14, back into the furnace section 54.

The vent pipe 59 equalizes the pressure in the recycle heat exchange section 56, and therefore the outlet chamber 58, to the relatively low pressure in the furnace section 54. Thus the fluidized solids level in the outlet chamber 58 establishes a solids head differential which drives the solids through the openings 14a to the furnace section 54.

It is understood that a drain pipe, hopper, or the like may be provided on the plate 22 for discharging spent solids from the furnace section 54 and the recycle heat exchange section 56 as needed.

Feed water is introduced to and circulated through the fluid flow circuit described above in a predetermined sequence to convert the feed water to steam and to reheat and superheat the steam. A desuperheater 88 is associated with the fluid flow circuit to remove heat from the steam when the temperature of the steam exceeds a desired level.

When the fluidized bed is operated at a constant load, an increase in the ratio of relatively fine to relatively coarse sorbent material being fed into the system decreases the average particle size in the recycle heat exchange section 56, and, at the same time, increases the ratio of entrained material to fluidizing gas. As the average particle size in the recycle heat exchange section 56 decreases, the heat transfer coefficient in the recycle heat exchange section increases. Also, as the ratio of entrained material to fluidizing gas increases, the temperature in the recycle heat exchange section 56 increases. Thus, at a constant fluidized bed reactor load, increasing the ratio of fine to coarse sorbent feed can increase both the heat transfer coefficient and the temperature in the recycle heat exchange section. Conversely, at a constant fluidized bed reactor load, decreasing the ratio of fine to coarse sorbent feed can decrease both the heat transfer coefficient and the temperature in the recycle heat exchange section.

When the fluidized bed reactor load increases, the heat transfer to the steam circulating in the fluid flow circuit is increased, and this causes an attendant increase in the temperature of the steam. Since it is desirable to maintain a constant steam temperature over a range of loads, such as, for example, 70% to 100% of capacity, a desuperheater is used to remove heat from the steam as the temperature of the steam begins to exceed a desired value. As the load further increases, the desuperheater duty also increases. This increase in desuperheater duty is very inefficient and results in other operational disadvantages, as discussed above.

According to the method of the present invention, as the heat transfer to the steam circulating in the fluid flow circuit increases, in response to increases in load demands, to a point at which the temperature of the steam begins to exceed the desired value, the ratio of fine to coarse sorbent feed is decreased, thereby decreasing both the heat transfer coefficient and the temperature in the recycle heat exchange section. The decrease in the heat transfer coefficient and the decrease in temperature in the recycle heat exchange section together operate to offset the increase in temperature by reducing the amount of heat that would otherwise be transferred to the steam by the recycle heat exchange section. A desuperheater may be used to remove heat from the steam to further offset the increase in temperature, however the method of the present invention reduces or eliminates the need for inefficient desuperheater duty which would otherwise be necessary to maintain the steam temperature at a desired level.

Conversely, as the heat transfer to the steam circulating in the fluid flow circuit decreases, in response to decreases in load demands, to a point at which the temperature of the steam circulating in the fluid flow circuit begins to drop below a desired value, the ratio of fine to coarse sorbent feed is increased, thereby increasing both the heat transfer coefficient and the temperature in the recycle heat exchange section. The increases in the heat transfer coefficient and temperature in the recycle heat exchange section together operate to offset the decrease in temperature by increasing the amount of heat that would otherwise be transferred to the steam by the recycle heat exchange section.

In the above manner, the steam circulating in the fluid flow circuit may thus be maintained at a constant temperature over a range of fluidized bed reactor loads, by controlling the ratio of fine to coarse sorbent material introduced into the furnace section.

Additionally, controlling the ratio of fine to coarse sorbent feed introduced into the furnace section allows faster load changes by hastening the return to optimum conditions, e.g. the desired steam temperature, upon changes in the ratio of fine to coarse sorbent feed. Since the heat exchange surfaces in fluidized bed reactors are typically oversized so that the desired steam temperature can be reached at a relatively low load, such as at 75% of capacity, increasing the ratio of fine to coarse sorbent feed allows higher steam temperatures to be reached at a given load, and thus reduces oversizing requirements.

The fluidized bed combustion method of the present invention has several advantages. It allows the steam circulating in the fluid flow circuit to be maintained at a constant temperature over a relatively wide range of fluidized bed reactor loads while reducing or eliminating the need for costly and inefficient desuperheating of the steam. Further, it reduces the need to oversize heat exchange surfaces in the fluid flow circuit for the maintenance of a fairly constant temperature over a range of fluidized bed reactor loads. It permits faster start-ups and load changes by enabling optimum conditions to be reached and returned to rapidly. Finally, it utilizes sorbent of varying particle sizes to improve and control operational characteristics and to permit the solids inventory in the furnace combustor to be adjusted rapidly as demanded by operational requirements.

A latitude of modification, change and substitution is intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed combustion method comprising:

(a) forming a furnace section and a recycle heat exchange section;

(b) introducing fuel particles into said furnace section;

(c) combusting said fuel particles to form gaseous and solid products of combustion;

(d) introducing relatively fine and relatively coarse sorbent material into said furnace section at a ratio of said fine to said coarse sorbent material;

(e) fluidizing said furnace section with a fluidizing gas so that said fluidizing gas combines with said gaseous products of combustion to form flue gases which entrain portions of said fuel particles, said solid products of combustion, and said fine and said coarse sorbent materials;

(f) passing said flue gases and said entrained material from said furnace section;

(g) separating said entrained material from said flue gases;

(h) passing said separated entrained material to said recycle heat exchange section to cool said separated entrained material;

(i) passing said cooled entrained material to said furnace section;

(j) establishing a fluid flow circuit to transfer heat from said separated entrained material in said recycle heat exchange section to a fluid passing through said circuit, thereby heating said fluid; and (k) varying said heat transfer to said fluid;

(l) adjusting said ratio of fine to coarse sorbent feed in response to said variation in said heat transfer to offset said variation in said heat transfer.

2. The method of claim 1 wherein said ratio of fine to coarse sorbent feed is adjusted by increasing said ratio of fine to coarse sorbent feed in response to a decrease in said heat transfer to said fluid to offset said decrease in said heat transfer.

3. The method of claim 1 wherein said ratio of fine to coarse sorbent feed is adjusted by decreasing said ratio of fine to coarse sorbent feed in response to an increase in said heat transfer to said fluid to offset said increase in said heat transfer.

4. The method of claim 3 further comprising removing heat from said fluid to further offset said increase in said heat transfer to said fluid.

5. The method of claim 4 further comprising forming a heat recovery section, and passing said separated flue gases to said heat recovery section.

6. The method of claim 1 further comprising removing heat from said fluid to control the temperature of said fluid.

7. The method of claim 1 further comprising forming a heat recovery section, and passing said separated flue gases to said heat recovery section.

8. The method of claim 1 wherein said step of varying said heat transfer to said fluid is in response to changes in load demands.

9. A method for controlling a steam generating system comprising:

(a) forming a furnace section and a recycle heat exchange section;

(b) introducing fuel particles into said furnace section;

(c) combusting said fuel particles to form gaseous and solid products of combustion;

(d) introducing relatively fine and relatively coarse sorbent material into said furnace section at a ratio of said fine to said coarse sorbent material;

(e) fluidizing said furnace section with a fluidizing gas so that said fluidizing gas combines with said gaseous products of combustion to form flue gases which entrain portions of said fuel particles, said solid products of combustion, and said fine and said coarse sorbent materials;

(f) passing said flue gases and said entrained material from said furnace section;

(g) separating said entrained material from said flue gases;

(h) passing said separated entrained material to said recycle heat exchange section to cool said separated entrained material;

(i) passing said cooled entrained material to said furnace section;

(j) establishing a fluid flow circuit having a cooling fluid passing through said circuit;

(k) transferring heat from said furnace section and said recycle heat exchange section to said fluid in response to load demands on said system;

(l) increasing said heat transfer to said fluid in response to increases in said load demands up to a predetermined value of said load demands;

(m) further increasing said heat transfer to said fluid in response to increases in said load demands above said predetermined value; and (n) decreasing said ratio of fine to coarse sorbent feed in response to increases in said load demands above said predetermined value to offset said further increase in said heat transfer to said fluid.

10. The method of claim 9 further comprising removing heat from said fluid in response to increases in said load demands above said predetermined value to further offset said increase in said heat transfer to said fluid.

11. The method of claim 9 further comprising forming a heat recovery section, and passing said separated flue gases to said heat recovery section.

12. A method for controlling a steam generating system comprising:

(a) forming a furnace section and a recycle heat exchange section;

(b) introducing fuel particles into said furnace section;

(c) combusting said fuel particles to form gaseous and solid products of combustion;

(d) introducing relatively fine and relatively coarse sorbent material into said furnace section at a ratio of said fine to said coarse sorbent material for adsorbing sulfur generated by combustion of said fuel particles;

(e) fluidizing said furnace section with a fluidizing gas so that said fluidizing gas combines with said gaseous products of combustion to form flue gases which entrain portions of said fuel particles, said solid products of combustion, and said fine and said coarse sorbent materials;

(f) passing said flue gases and said entrained material from said furnace section;

(g) separating said entrained material from said flue gases;

(h) passing said separated entrained material to said recycle heat exchange section to cool said separated entrained material;

(i) passing said cooled entrained material to said furnace section;

(j) establishing a fluid flow circuit having a cooling fluid passing through said circuit;

(k) transferring heat from said furnace section and said recycle heat exchange section to said fluid in response to load demands on said system;

(l) increasing said heat transfer to said fluid in response to increases in said load demands to cause an increase in temperature of said fluid to a predetermined temperature; and (m) decreasing said ratio of said fine to said coarse sorbent material introduced into said furnace section in response to increases in temperature of said fluid above said predetermined temperature to offset said increase in said temperature.

13. The method of claim 12 further comprising removing heat from said fluid in response to increases in temperature of said fluid above said predetermined temperature to further offset said increase in said temperature.

14. The method of claim 12 further comprising forming a heat recovery section, and passing said separated flue gases to said heat recovery section.

15. A fluidized bed combustion method comprising:

(a) forming a furnace section and a recycle heat exchange section;

(b) introducing fuel particles into said furnace section;

(c) combusting said fuel particles to form gaseous and solid products of combustion;

(d) introducing relatively fine and relatively coarse sorbent material into said furnace section at a ratio of said fine to said coarse sorbent material;

(e) fluidizing said furnace section with a fluidizing gas so that said fluidizing gas combines with said gaseous products of combustion to form flue gases which entrain portions of said fuel particles, said solid products of combustion, and said fine and said coarse sorbent materials;

(f) passing said flue gases and said entrained material from said furnace section;

(g) separating said entrained material from said flue gases;

(h) passing said separated entrained material to said recycle heat exchange section to cool said separated entrained material;

(i) passing said cooled entrained material to said furnace section;

(j) establishing a fluid flow circuit to transfer heat from said separated entrained material in said recycle heat exchange section to a fluid passing through said circuit;

(k) achieving a desired temperature for said fluid;

(l) increasing said heat transfer to said fluid after said fluid achieves said desired temperature; and (m) decreasing said ratio of fine to coarse sorbent feed introduced into said furnace section to offset said increase in said heat transfer to said fluid.

16. The method of claim 15 further comprising removing heat from said fluid to further offset said increase in said heat transfer to said fluid.

17. The method of claim 15 further comprising forming a heat recovery section, and passing said separated flue gases to said heat recovery section.

18. The method of claim 15 wherein said step of increasing said heat transfer to said fluid is in response to increases in load demands.

19. A fluidized bed combustion method comprising:

(a) forming a furnace section and a recycle heat exchange section;

(b) introducing fuel particles into said furnace section;

(c) combusting said fuel particles to form gaseous and solid products of combustion;

(d) introducing relatively fine and relatively coarse sorbent material into said furnace section at a ratio of said fine to said coarse sorbent material for adsorbing sulfur generated by combustion of said fuel particles;

(e) fluidizing said furnace section with a fluidizing gas so that said fluidizing gas combines with said gaseous products of combustion to form flue gases which entrain portions of said fuel particles, said solid products of combustion, and said fine and said coarse sorbent materials;

(f) passing said flue gases and said entrained material from said furnace section;

(g) separating said entrained material from said flue gases;

(h) passing said separated entrained material to said recycle heat exchange section to cool said separated entrained material;

(i) passing said cooled entrained material to said furnace section;

(j) establishing a fluid flow circuit to transfer heat from said separated entrained material in said recycle heat exchange section to water or steam or a water-steam mixture passing through said circuit;

(k) heating said water or steam or water-steam mixture so that said water or steam or water-steam mixture is converted to superheated steam having a desired temperature;

(l) increasing said heat transfer to said superheated steam, thereby causing an increase in temperature of said superheated steam above said desired temperature; and (m) decreasing said ratio of fine to coarse sorbent feed introduced into said furnace section to offset said increase in temperature of said superheated steam.

20. The method of claim 19 further comprising removing heat from said superheated steam to further offset said increase in temperature of said superheated steam.

21. The method of claim 19 further comprising forming a heat recovery section, and passing said separated flue gases to said heat recovery section.

22. The method of claim 19 wherein said step of increasing said heat transfer to said superheated steam is in response to increases in said load demands.

* * * * *